United States Patent [19]

Ritten

[11] Patent Number: 4,719,872

[45] Date of Patent: Jan. 19, 1988

[54] BOAT LADDERS

[75] Inventor: Robert G. Ritten, Ft. Pierce, Fla.

[73] Assignee: Step-On Inc., Ft. Pierce, Fla.

[21] Appl. No.: 917,801

[22] Filed: Oct. 10, 1986

[51] Int. Cl.[4] ..... B63B 27/14

[52] U.S. Cl. ..... 114/362; 182/93; 182/100

[58] Field of Search ..... D12/317; 114/345, 362; 248/210; 182/82, 93, 84, 100, 127

[56] References Cited

U.S. PATENT DOCUMENTS

D. 176,238 11/1955 Wallace et al. ..... D12/317 X 3,512,608 5/1970 Huntley ..... 182/93

*Primary Examiner*—Sherman D. Basinger

*Attorney, Agent, or Firm*—Carroll F. Palmer

[57] ABSTRACT

Ladders for use with inflatable boats or other watercraft include a mounting bracket and a movable boarding step unit having a plurality of steps fixed to an elongated support bar. The mounting bracket is fixed to the transom or other vertical portion of the watercraft and the support bar is contoured so that when its upper end is positioned in the bracket, the steps depend below the watercraft and are firmly held away from it by a portion of the bar bearing against a portion of the watercraft adjacent the mounting bracket.

5 Claims, 13 Drawing Figures

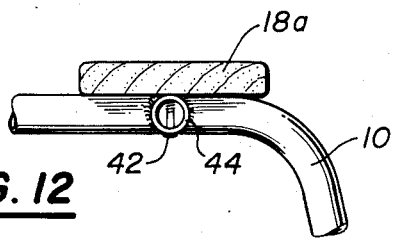
FIG. 12
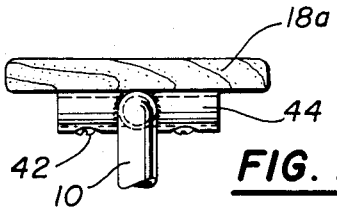
FIG. 13
FIG. 5
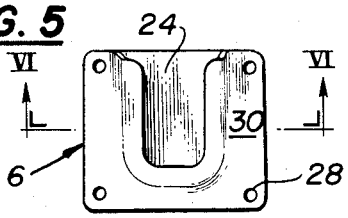
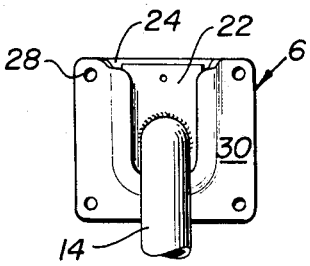
FIG. 8
FIG. 6
FIG. 7
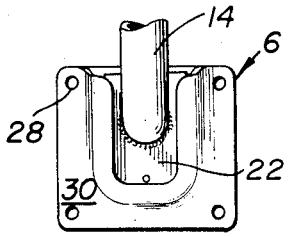
FIG. 9
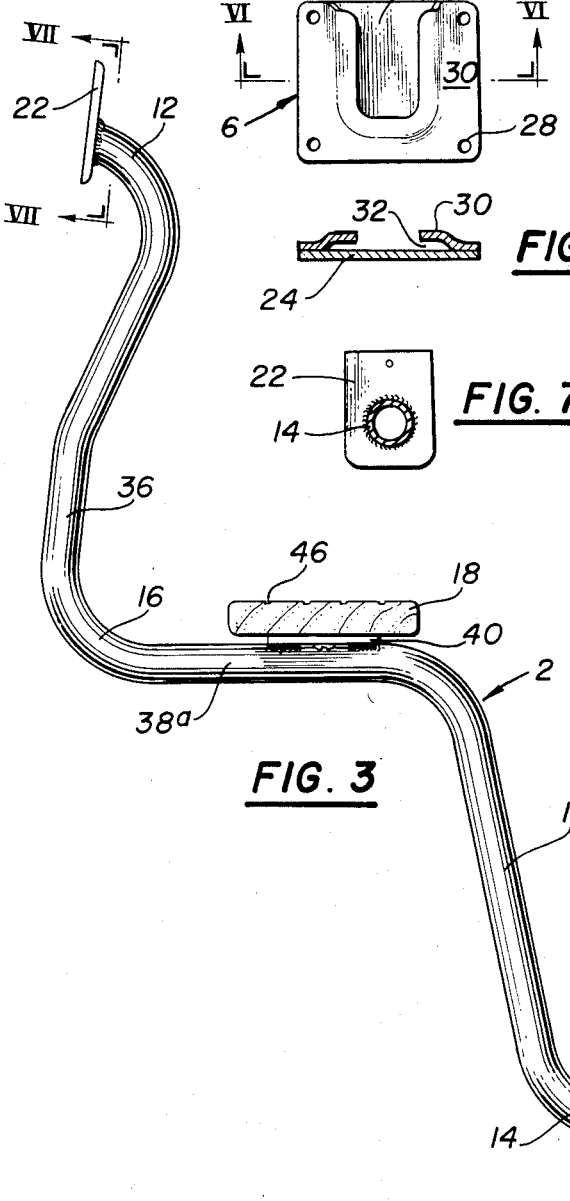
FIG. 3
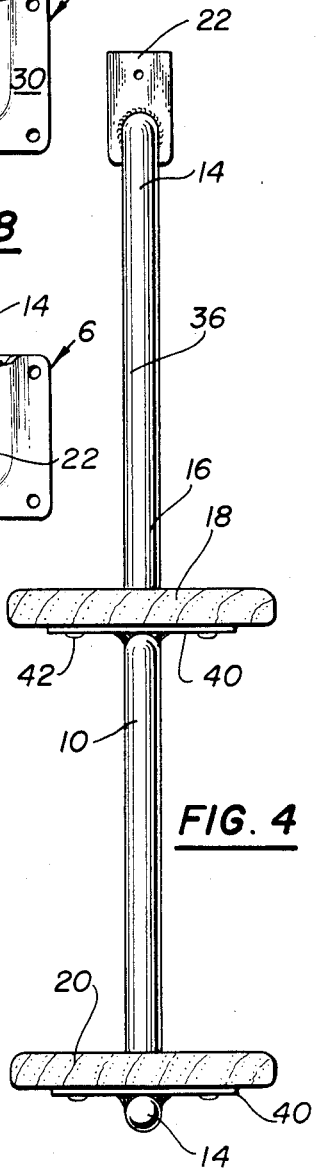
FIG. 4

BOAT LADDERS

BACKGROUND OF THE INVENTION

1. Field of the Invention

The invention relates broadly to ladders to be attached to the transoms or other vertical parts of boats in assist persons using the boats to board the boat from a position immersed in the water beside the boat or to safely debark from the boat even when loaded with scuba equipment or other gear. More particularly, it concerns boat ladders that may be attached to inflatable boats or other runabout type watercraft that permit easy and safe access into or out of the water surrounding the boat.

2. Description of the Prior Art

A variety of ladder devices have been developed and marketed for attachment to boats to assist in boarding or debarking the boats. These prior devices can be divided broadly into three classes, i.e., (1) those that are permanently attached to vertical postions of boats, (2) those which are attached to platforms that extend from boats and (3) those that hang from or are otherwise removably and vertically supported on boats. The present invention relates the devices of the third type.

Many prior art devices of the third type are separate ladders that hang on the side or stern of a boat in a manner that the steps are not sturdily fixed when the device is installed on the boat in a climbing position with the result that the user is bothered by having to lift his body on an unsteady step. This is particularly bothersome when the user is carrying heavy gear, e.g., scuba gear, since the added weight serves to aggravate the unstable condition. I previously disclosed and claimed in my prior U.S. Pat. No. 4,462,485 improved ladder devices which eliminated such deficiency of some prior known devices. However, the ladders of that patent were not designed for use with inflatable boats or other runabout type boats not equipped with transom platforms and this present invention addresses this problem

OBJECTS

A principal object of the invention is the provision of new improvements in boat ladders of the removable type.

Further objects include the provision of:

1. New forms of boat ladders for use on inflatable boats, other runabout type motorboat and sailboats that are not equipped with stern or like outboard platforms.
2. Such ladders capable of easy "slip-in" installation and removal.
3. Such ladders that may be stored on the boat out of the water on their own mounting hardware.
4. Such ladders having improved safety and function features.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of ladders for use with inflatable boats or other runabout type watercraft basically made up of a mounting bracket and a moveable boarding step unit.

The step units comprise an elongated support bar including an upper end, a lower end and an elongated central portion integrally joining the upper end to the lower end. A plurality of steps are fixed, vertically spaced apart to the support bar and a latch plate is fixed transversely to the upper end of the support bar.

The mounting bracket comprises a flat back to engage the transom or other support surface of the watercraft, a face web fixed to the back, an opening between the back and the web sized to slideably receive and capture the latch plate of the support bar and a U-shaped slot in the face web to admit the upper end of the support bar.

The central portion of the support bar has a section contoured so that when the latch plate is positioned in the bracket, the steps depend below the watercraft and are firmly held away from it by a part of the central portion of the bar bearing against the support surface of the watercraft.

In preferred embodiments, the step units have an upper step with at least one lower step and the contoured section of the central portion of the support bar is above the upper step and consists of an S-curve. Also, the support bar contains a plurality of bends transverse to its longitudinal axis and the steps are fixed to the transverse bends, e.g., the steps are made of wood, metal plates are welded to the transverse bends and the wooden steps are fixed by fasteners to the metal plates. Alternatively, metal tubes, instead of plates, are welded to the transverse bends and the wooden steps are fixed by fasteners to such metal tubes.

BRIEF DESCRIPTION OF THE DRAWINGS

A more complete understanding of the invention may be had by reference to the accompanying drawings in which:

FIG. 3 is a lateral view of the removable boarding step unit of the boat ladder shown in FIG. 2.

FIG. 4 is a plan view of the step unit.

FIG. 5 is a plan view of a mounting bracket of the invention.

FIG. 6 is a sectional view taken on the line VI—VI of FIG. 5.

FIG. 7 is a sectional view taken on the line VII—VII of FIG. 3.

FIG. 8 is a fragmentary view of the bracket and upper end of the step unit as shown in FIG. 2.

FIG. 9 is a fragmentary view related to FIG. 8, but with the step unit turned upside-down for storage of the boat ladder on the boat and out of the water.

DESCRIPTION OF THE PREFERRED EMBODIMENTS

Figure 1:
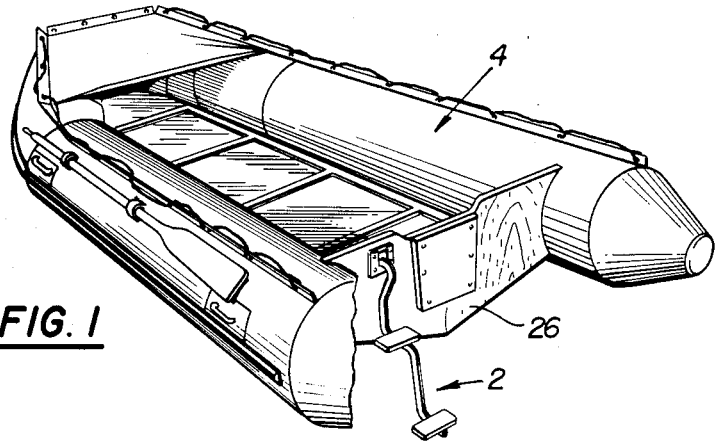
FIG. 1 is a perspective view of an inflatable boat with a ladder of the invention attached to the transom board.

Referring in detail to the drawings, in which identical parts are identically marked, a ladder 2 of the invention for use with an inflatable boat 4, other runabout type motorboat or sale boat comprises a mounting bracket 6 and a moveable boarding step unit 8.

The step units 8 comprise an elongated support bar 10 including an upper end 12, a lower end 14 and an elongated central portion 16 integrally joining the upper end 12 to the lower end 14. An upper step 18 and at least one lower step 20 are fixed, vertically spaced apart on the support bar 10. Also, a latch plate 22 having a U-shaped peripheral edge is fixed transversely to the upper end 12 of the support bar 10.

The mounting bracket 6 comprises a flat back 24 fastened to the transom 26 or other support surface of the boat 4 by screws 28 or other suitable fasteners.

The bracket 6 also has a face web 30 fixed to the back 24. For example, the back 24 and face web 30 can be formed from stainless steel sheets or plates and welded or otherwise fixed together.

There is an opening 32 between the back 24 and the web 30 sized to slideably receive and capture the latch plate 22. A U-shaped slot 34 in the face web admits the upper end 12 of the support bar 10. The opening 32 is made by suitable bending or pressing of the web 30 after the slot 34 has be cut or stamped therein.

The central portion 16 of the support bar has a section 36 contoured so that when the latch plate is positioned in the bracket, the steps 18 & 20 depend below the boat 4 and are firmly held away from it by the section 36 of the central portion of the bar bearing against the boat transom 26. In preferred embodiments, the contoured section 36 of the central portion 16 of the support bar 10 is above the upper step 18 and consists of an S-curve (see FIG. 3).

Also, the support bar 10 contains a plurality of bends **38*a* & 38*b* transverse to its longitudinal axis and the steps 18 & 20 are fixed to the transverse bends 38*a* & 38*b* respectively. By way of example, the steps are made of wood and metal plates 40 are welded to the transverse bends 38*a* & 38*b* and the wooden steps 18 & 20 are fixed by fasteners 42 to the metal plates 40. Alternatively, metal tubes 44 (see FIGS. 12 & 13), instead of plates, are welded to the transverse bends 38*a* & 38*b* and the wooden steps 18*a* are fixed by fasteners 42 to the metal tubes 44**.

Figure 10:
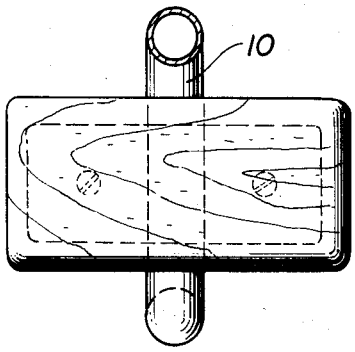
FIG. 10 is a top view of another embodiment of a step portion of a ladder of the invention.
Figure 11:
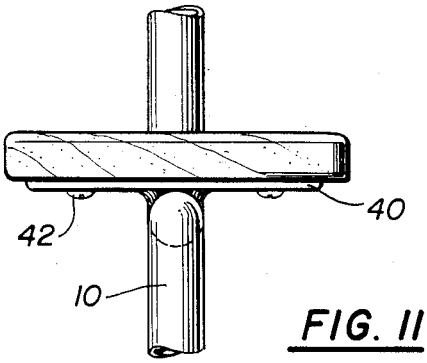
FIG. 11 is a plan view corresponding to FIG. 10.

In the ladders of FIGS. 3 & 4, the steps 18 & 20 have anti-slip grooves 46 in their upper surface. In contrast, the steps 46 of FIGS. 10 & 11 have ungrooved upper surfaces. As a further modification, the steps may be formed of molded plastics, cast resins, foam cored wood or plastic, etc.

Figure 2:
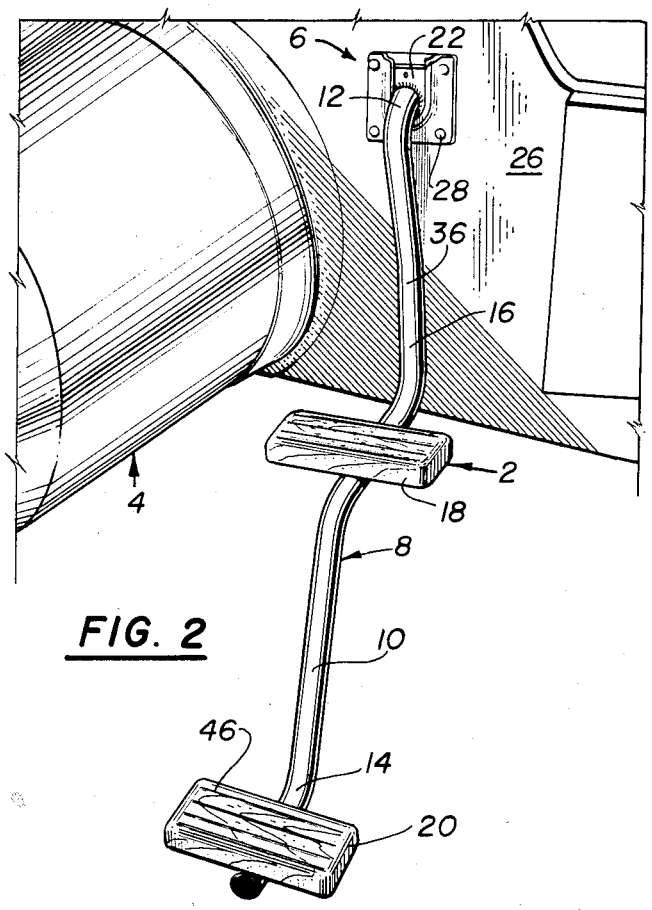
FIG. 2 is a fragmentary, enlarged, perspective view of the ladder bearing transom portion of the boat shown in FIG. 1.

The positioning of the new ladders 2 for a passenger (not shown) of the boat 4 to use in getting into or out of the boat is illustrated in FIGS. 1 & 2. In such position with the latch plate 22 locked in bracket 6, the S-curve section 36 bears against the transom 26 of the boat 4 so that the depending steps 18 & 20 are firmly held out and away from the boat transom 26 by action of bar section 36. Further, frictional engagement of the section 36 with transom 26 and the locking of the latch plate 22 into the bracket 6 keeps the bar 10 from swinging whereby the steps 18 & 20 remain substantially fixed relative to the boat and rearward of the transom 26 so that a person can place feet on the steps 18 & 20 with confidence that they will not swing forward or sideways, as often occurs with many prior know removable boat ladder and usually results in the user being dumped into the water. Furthermore, the narrow configuration of the new ladders 2 permits them to be used on boat transoms of narrow width even with large outboard motors hanging thereon.

The steadiness of the steps of the new ladders is such that divers loaded with air tanks and other gear can safely leave and enter boats equipped with the new ladders 2. This is of particular significance to inflatable boats, e.g., "Avon" and "Achilles" types, where boarding with scuba gear attached has been a constant problem heretofore.

When not in use, the ladders 2 may be removed from the brackets 6 and stored aboard without difficulty because of their compact size. However, where stowage space is very limited, as is often the case with inflatble boats loaded with diving gear, the ladders 2 may be stored outboard by being turned upside down and mounted in their bracket (see FIG. 9).

The embodiments of the invention in which an exclusive property or privilege is claimed are defined as follows:

1. A ladder for use with inflatable boats or other runabout type watercraft comprising:

a single mounting bracket and a moveable boarding step unit, said step unit comprising:

a single elongated support bar including:

an upper end, a lower end and an elongated central portion integrally joining said upper end to said lower end, a plurality of steps fixed, vertically spaced apart to said support bar and a latch plate having a U-shaped peripheral edge fixed transversely to said upper end of said support bar;

said mounting bracket comprising:

a flat back to engage the transom or other support surface of said watercraft, a face web fixed to said back, an opening between said back and said web sized to slideably receive and capture said latch plate and a U-shaped slot in said face web to admit said upper end of said support bar, said central portion of said support bar has a section contoured so that when said latch plate is positioned in said bracket, said steps depend below said watercraft and are firmly held away from it by a part of said central portion of said bar bearing against said support surface of said watercraft.

2. The ladder of claim 1 wherein:

said step unit includes an upper step and at least one lower step.

said contoured section of said central portion of said support bar is above said upper step and consists of an S-curve.

3. The ladder of claim 1 wherein said said central portion of said support bar contains a plurality of bends transverse to the longitudinal axis thereof and said steps are fixed to said transverse bends.

4. The ladder of claim 3 wherein said steps are made of wood, metal plates are welded to said transverse bends and said wooden steps are fixed by fasteners to said metal plates.

5. The ladder of claim 3 wherein said steps are made of wood, metal tubes are welded to said transverse bends and said wooden steps are fixed by fasteners to said metal tubes.

* * * * *